United States Patent [19]

Kersey

[11] Patent Number: 5,003,995

[45] Date of Patent: Apr. 2, 1991

[54] COMPOSITIONS AND ARTICLES FOR STIMULATING TASTE RECEPTORS

[75] Inventor: Robert L. Kersey, Morehead City, N.C.

[73] Assignee: Tripar Incorporated, Stamford, Conn.

[21] Appl. No.: 458,087

[22] Filed: Dec. 28, 1989

[51] Int. Cl.[5] ..... A24D 1/18; A24B 15/28

[52] U.S. Cl. ..... 131/359; 131/369; 131/352

[58] Field of Search ..... 131/359, 369, 352, 335, 131/275, 276

[56] References Cited

U.S. PATENT DOCUMENTS 4,719,929 1/1988 Breckwoldt ..... 131/369

4,807,648 1/1988 Breckwoldt ..... 131/369

*Primary Examiner*—V. Millin

*Attorney, Agent, or Firm*—Kane, Dalsimer, Sullivan, Kurucz, Levy, Eisele and Richard

[57] ABSTRACT

A smoking or non-smoking material comprises a volatile-releasing substrate bearing a flavor enhancing proportion of distiller's dried solubles. The composition is useful to pleasurably stimulate a taste sensation. In one use, the composition of the invention is disposed in a cigarette like form to simulate a cigarette and used in a similar manner to give the "smoker" pleasure and oral gratification. In other words, the substrate is smokable.

18 Claims, 1 Drawing Sheet

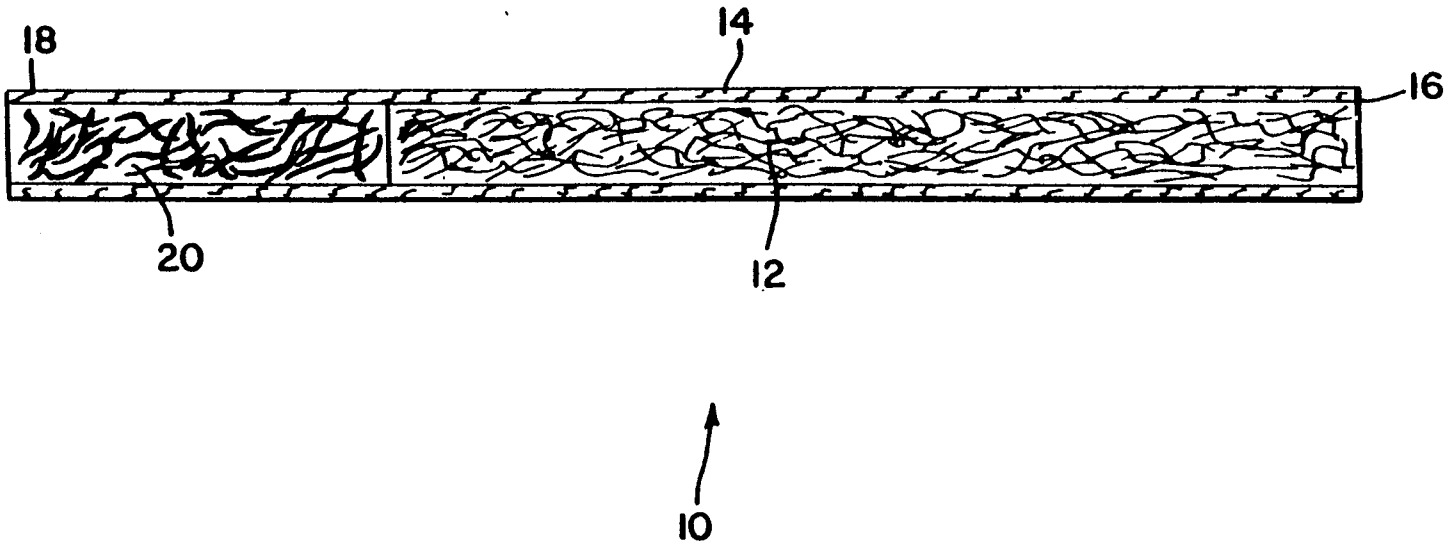
16
14
12
10
20
18

COMPOSITIONS AND ARTICLES FOR STIMULATING TASTE RECEPTORS

BACKGROUND OF THE INVENTION

1. Field of the Invention

The invention relates to articles and compositions for stimulating the taste receptors of a human and more particularly relates to both smoking and non-smoking articles, non-edible but taste receptor stimulating.

2. Brief Description of the Prior Art

Distillers dried grain with solubles has been used to improve the flavor of smoking materials (see U.S. Pat. No. 4,693,266), including non-tobacco smoking materials (U.S. Pat. No. 4,719,929) and nonburning tobacco substitutes (U.S. Pat. No. 4,807,648).

I have now found that, surprisingly an active taste receptor-affecting ingredient of the distilled dried grain with solubles (DDGS) is the solubles portion thereof and its use separate and apart from the fiber or suspended solids portion has a better effect on the taste receptors of a human, when used in the form of a volatile coating on a volatile-releasing substrate, without the presence of the fiber.

Summary of the Invention

The invention comprises an article for stimulating the taste receptors of a human, which comprises; a volatile-releasing substrate, adapted by size, configuration and material make-up for insertion at least partially into the buccal cavity of the human; and a taste receptor stimulating proportion of volatilizable distillers dried solubles coated on the substrate.

Stimulation of the human taste receptors, i.e.; the taste buds is often pleasurable and generally sought after by many individuals. Taste sensation is a highly complex physiological response to solvated materials brought in contact with the taste buds, combined with simultaneous odor sensations. Articles or compositions for pleasurably stimulating taste sensations are ideally operative to produce a volatilized substance for effecting an odor sensation and for dissolution in saliva for direct contact with taste buds. The articles and compositions of the present invention meet this ideal.

BRIEF DESCRIPTION OF THE DRAWING

The accompanying drawing is a cross-sectional side elevation of an embodiment article of the invention.

DETAILED DESCRIPTION OF THE PREFERRED EMBODIMENTS OF THE INVENTION

Distiller's dried grain with solubles (referred to hereinafter at times as "DDGS") is the product obtained upon drying stillage (sometimes called "slop"), which is the residue after distillation and removal of alcohols from beer or fermented grain mash. It is described for example in the U.S. Pat. No. 4,693,266. Typically the DDGS is prepared by first separating fiber solids from the stillage, for example, by centrifugation. The liquid residue of soluble solids (called hereinafter "thin stillage") is then concentrated by evaporation to the consistency of a paste (called distiller's dried solubles [referred to hereinafter at times as "DDS"]) and then remixed with the separated fiber. The remixed fiber and DDS is then dried to obtain a meal which is powdered to obtain the DDGS employed in the prior art described above. It is the distiller's dried solubles (DDS) which is used in the present invention, in the absence of the fibers.

The DDS is readily available from commercial sources. The composition of DDS is well known. A typical DDS composition will comprise crude protein (27 percent by weight), crude fats (9 percent by weight) and crude fiber (4 percent by weight); dry matter constituting about 91.5 percent by weight.

In one embodiment of the invention, the substrate for carrying the DDS is a form of smokable tobacco, thereby using a tobacco smoking article as the article of the invention for delivery of taste stimulation.

The smoking material embodiment of the invention is prepared by homogeneously mixing the DDS with a smokable tobacco form. Representative of such tobacco is shredded tobacco leaf, useful in the manufacture of cigarettes and pipe-smoking blends. The DDS may also be mixed with reconstituted tobacco. The resultant product of either mixture is preferentially used as cigar or cigarette filler. Reconstituted tobacco may comprise a mixture of tobacco stems, laminas, fines and like tobacco plant components or remnants. Reconstituted tobacco webs or paper and the method of their manufacture are well known to those skilled in the art; see for example the descriptions given in the U.S. Pat. No(s). 3,297,039 and 4,542,755 (which are incorporated herein by reference thereto). Advantageously, the DDS to be added to the tobacco will be in a paper form, said paper form obtained by blending the DDS with appropriate binding agents such as bleached cellulose fibers (preferably flax fibers) sufficient in quantity to produce a paper product similar in character to reconstituted tobacco.

Mixing of the DDS with the smokable tobacco may be carried out using conventional blending apparatus, conventionally used to mix tobacco with previously known tobacco additives. The proportion of DDS homogeneously blended with or added to the smokable tobacco to obtain the smoking material articles of the invention is a smoke-enhancing proportion. In general, a smoke-enhancing proportion will be an amount within the range of from about 0.2 to 80 percent by weight of the tobacco ingredient; preferably about 0.3 to 5 percent; most preferably 0.3 to 3 percent.

In addition to DDS and tobacco the smoking materials of the invention may contain conventionally employed proportions of conventionally known tobacco additives such as flavorants (like menthol), binders, humectants (like propylene glycol, sorbitol and the like), mold inhibitors such as Mycoban ® sold by Pfizer, extenders or fillers (like hydroxymethylcellulose), flavor enhancers and the like. For this purpose, the additive may be pre-mixed with the DDS or thin-stillage used to prepare the DDS prior to admixture with its smoking material.

When smoked, the DDS is volatilized and the vapor brought into contact with the smoker's taste buds and smell receptors, delivered by the vapor-releasing substrate (tobacco).

The articles of the invention are not limited to tobacco substrates for releasing the DDS vapor. In another embodiment of the invention, non-tobacco smoking materials may be used as vapor-releasing substrates for the DDS in providing articles of the invention.

In this embodiment of the invention the smoking material substrate may be prepared by homogeneously mixing the DDS with a smokable form of cellulose, free of tobacco or tobacco extracts. Representative of smokable forms of cellulose are vegetable cellulose pulps such as pulps of softwood trees, hydroxymethyl cellulose, hydroxyethyl cellulose, carboxymethyl cellulose, methyl cellulose, ethyl cellulose, hydroxypropyl cellulose, carboxymethyl hydroxyethyl cellulose and the like. Flax derived cellulose is preferred.

A homogeneous blend of the cellulose carrier and the DDS may be obtained by bringing the two components together and mixing them together employing conventional equipment and mixing techniques. For example, blending may be carried out in a conventional tobacco blending chest.

Advantageously, the blend of cellulose and DDS is wet processed into a dry sheet or web (analogous to a sheet of paper). The method of processing such a blend into a dry sheet is well known and may be that described in the U.S. Pat. No(s). 3,297,039 and 4,542,755 described above.

The proportion of DDS homogeneously blended with or added to the smokable cellulose to obtain smoking material of the invention is a smoke-enhancing proportion. In general a smoke-enhancing proportion will be an amount within the range of from about 0.2 to 80 percent by weight of the cellulose carrier; preferably about 0.3 to 5 percent; most preferably 0.3 to 3 percent.

In addition to DDS and cellulose the non-tobacco smoking materials of the invention may contain conventionally employed proportions of conventionally known tobacco additives such as flavorants (like menthol), binders, humectants (like propylene glycol, sorbitol and the like), mold inhibitors, extenders or fillers, flavor enhancers and the like. As previously mentioned, the additive can be pre-mixed with the DDS or thin stillage prior to application to the substrate material.

Representative of specific additives which may be employed are:

acetophenone
alfalfa extract
chamomile flower extract
vanillin
heliotropin
2,3,5,6-tetramethyl pyrazine
2,3,5-trimethyl pyrazine
licorice extract
cocoa extract
molasses
clary sage oil
st. johns bread extract
valerian root extract
oakmoss absolute mixtures thereof and the like.

The non-tobacco compositions described above may also be used to case harsh smoking tobacco of any type and source, thereby modifying the tobacco smoke to obtain a mellower, more desirable tobacco smoke. When used as a casing, the tobacco compositions of the invention may include a proportion of from 2 to 25 parts by weight of the tobacco, of the non-tobacco compositions.

Used alone or in admixture with tobacco as a casing, the taste receptor stimulating compositions of the invention may be incorporated into conventional smoking articles such as cigarettes by wrapping in conventional papers and, optionally with added filter elements. The methods of manufacture of such articles are well known; see for example U.S. Pat. No. 4,553,555.

In a preferred embodiment article of the invention, the substrate for holding the DDS is a composition of natural material, useful as a nonburning substitute for tobacco.

In recent years there has been concern about the biological effect of both tobacco and cellulose smoke upon the smoker and humans exposed to the smoke (passive smokers). Many of the compounds identified in tobacco smoke are associated with health hazards, including lung carcinoma.

To obviate this health concern, attention has focused on non-combustible (non-burning), tobacco substitutes which can satisfy a smoker's need for oral gratification, physiological satisfaction and pleasure. Such compositions have an additional advantage in that their use obviates the danger of igniting an accidental fire, often associated with lit smoking articles.

The present invention includes a composition which is useful as a non-burning tobacco substitute, and which may be used in the same manner as a smoking article such as a cigarette. However, combustion of the material is not required for "smoking" pleasure. In one embodiment of the invention, nicotine may be present in the compositions of the invention to satisfy a user's physiological need for that ingredient.

In the present invention, DDS will function to provide a volatile (at room temperature) flavoring for a composition useful as the non-burning tobacco substitute. These compositions are prepared by homogeneously mixing the DDS with a volatile-releasing form of, for example, an organic carrier such as gum tragacanth, acacia (gum arabic), solka floc, guar gum, dextrin, and the like. Inorganic carriers such as sodium carbonate, calcium carbonate, and the like may also be employed to release vapors of DDS.

A homogeneous blend of the substrate carrier material and the DDS may be obtained by bringing the two components together and mixing them employing conventional equipment and mixing techniques. For example, blending may be carried out in a conventional tobacco blending chest.

Advantageously, a blend of non-smoking carrier and DDS is wet processed into a dry sheet or web (analogous to a sheet of paper). The method of processing such a blend into a dry sheet is well known and may be that described in the aforementioned U.S. Pat. No(s). 3,297,039 and 4,542,755. The resulting sheet may be shredded and used as a tobacco substitute in making a "cigarette" free of tobacco. As a preference, the compositions of the invention are processed into a porous rod on a conventional cigarette making machine. The rod may be wrapped with cigarette paper to make a non-burning simulated cigarette.

The proportion of DDS homogeneously blended with or added to the non-smoking carrier to obtain a composition of the invention is a flavor-enhancing proportion. In general, a flavor-enhancing proportion will be an amount within the range of from about 0.2 to 95 percent by weight of the non-smoking carrier.

In addition to DDS and non-smoking carrier the embodiment compositions of the invention may contain proportions of conventionally known tobacco additives such as conventional flavorants (like menthol, strawberry, apple flavoring), binders, humectants (like propylene glycol, sorbitol and the like), pH modifiers, extenders or fillers, flavor enhancers and the like. These additives may be incorporated into the products of the invention separately or may be pre-mixed with the thin stillage used to prepare the DDS.

Representative of specific additives preferably employed are the specific additives mentioned above for use in cellulose carried DDS.

A preferred embodiment non-smoking composition of the invention includes nicotine as an active ingredient. The nicotine may be provided in the form of a low-volatility compound (such as an acid salt thereof or an ester of nicotine. Advantageously, the nicotine is present in a proportion of form 0.1 to 10 percent by weight of the total non-smoking composition.

Advantageously, the pH of the non-smoking compositions of the invention is adjusted to be within the range of from about 6.5 to 7.5 to assure that the acidity/alkalinity will not impact on the flavor perceived by the user. Adjustment may be made by the addition of small proportions of pH modifiers such as sodium bicarbonate, citric acid and the like.

The non-smoking compositions of the invention, in for example a gas porous rod form, may be used as follows. Advantageously, the rod element is enclosed in a paper wrapper or like cylinder tube to more closely simulate a conventional cigarette. The enclosed rod may be of a size and configuration to simulate the appearance of a conventional cigarette, and may have attached to one end, a filter element or simulated filter element to further give the impression of a conventional cigarette. The ends of the rod are unobstructed to the passage of gases so that the user may draw air through the rod body from end to end as is accomplished with a conventional cigarette.

In the above description, the preparation of tobacco, non-tobacco and non-smoking embodiments of the invention are by physical admixture of DDS with a volatile-releasing substrate such as tobacco. In a preferred process of the invention, the DDS is formed in-situ on the substrate. This is accomplished by coating the substrate with thin-stillage (see above description) and drying or evaporating the thin-stillage on the substrate, thereby forming DDS in-situ. The thin-stillage can be partially evaporated prior to its being coated on the substrate if so desired.

The use of thin-stillage as a means of introducing the DDS onto the substrate is an advantage, since liquids are used, facilitating coating of the substrates. Also, this method of application seems to enhance the effects of the DDS in final products.

The thin-stillage (TS) collected by removal of filterable fiber from stillage (by centrifugation) contains approximately 8 percent solids and comprises soluble compounds, the residue of stillage. In preparation for its use in the present invention, it may be filtered to remove filterable solids and evaporated to any stage of consistency between that associated with TS itself or the evaporation residue (DDS).

The filterable material found in TS, often separation, appears as soft particles, varying in size from about 1/16 inch to 3/32 inch. These soft particles may be crushed to form a paste, which may be returned to the TS filtrate and homogeneously dispersed therein as an unfilterable composition.

The composition of TS is that of DDS, diluted by the presence of volatiles, removable by evaporation.

Referring now to the accompanying drawing, there is seen a cross-sectional side elevation of an embodiment article 10 of the invention. The article 10 comprises a rod 12 of a smoking or non-smoking composition of the invention, porous to a gas. The rod 12 is covered by a conventional cigarette paper wrapper 14 and has a first end 16 open to the atmosphere. A second end 18 is fitted with a simulated filter tip element 20. In use, the "smoker" engages the element 20 with the lips and draws air into his/her mouth, from end 16 and through the body of rod 12. During passage of the air through the rod 12, flavor and aroma is picked up from the composition of the invention making up the rod 12 and entrained in the air. Volatile nicotine, if present, is similarly entrained, in the air taken into the user's mouth. The entrainment and carriage of the flavors and/or aromatic ingredients may use but does not require combustion of the rod 12, so long as the ingredients to be taken into the user's mouth are sufficiently volatile at room temperature. The active flavorants in the DDS are of such volatility. The user can also smell the volatilized DDS.

The following examples describe the manner and the process of making and using the invention and set forth the best mode contemplated by the inventor for carrying out the invention.

EXAMPLE 1

Handsheets of reconstituted tobacco are prepared by first blending together a mixture of tobacco fines, fiberized tobacco stems (particle sizes less than 60 mesh), 15 percent by weight of tobacco components of bleached southern pine softwood pulp and 5 percent by weight of DDS (flaked, average particle size less than 60 mesh). The blend, having a moisture content of circa 35 percent, is processed into handsheets by the general method described in Example 1 of U.S. Pat. No. 4,542,755. The handsheets are then shredded to obtain a cigarette smoking material of the invention.

EXAMPLE 2

The procedure of Example 1, supra., is repeated utilizing all DDS and other ingredients but containing no tobacco products whatsoever.

EXAMPLE 3

The shredded handsheet of Example 2 supra., is mixed with shredded tobacco at a level of 10% of the weight of the tobacco.

EXAMPLE 4

The procedure of Example 1, supra., is repeated except that the DDS component of the tobacco blend is replaced with an equal weight proportion of Distiller's dried grain with solubles (DDGS). This example is not an example of the invention but is made for comparative purposes.

The cigarette smoking material of Examples 1–4, supra., are smoked by a panel of ten smokers and judged for smoothness of smoke and flavor. A majority of the smoking panel chose the cigarette smoking material of the invention (Examples 1–3) as providing a smoother, more flavorful smoke than Example 4.

EXAMPLE 5

Handsheets of smokable material are prepared by first blending together a mixture of bleached southern pine softwood pulp (19.5% by weight) and 4.5 percent by weight of glycerin and 76% by weight of DDS (flaked, average particle size less than 60 mesh). The blend, having a moisture content of circa 35 percent, is processed into handsheets by the general method described in Example 1 of U.S. Pat. No. 4,542,755. The handsheets are then shredded to obtain a cigarette smoking material of the invention.

EXAMPLE 6

The shredded handsheet of Example 5 supra., is mixed with shredded Burley tobacco at a level of 10% of the weight of the tobacco as casing.

EXAMPLE 7

The smoking materials of Examples 5 and 6, supra., are separately incorporated into smoking articles (cigarettes) and smoked by a panel of smokers. The cigarettes are made up using medium porosity paper and monoacetate high pressure drop filters. The smoke obtained from the smoking material of Example 5 is found to be acceptable as a smoking article. The smoke obtained from the material of Example 6 is found to be smoother, less harsh than smoke from the original tobacco cased with the material of Example 5. The casing of the tobacco mellows the tobacco and lends a "sweet-woody" note.

EXAMPLE 8

A composition is prepared by blending together the following ingredients:

| | |
|---|---|
| granular DDS | 80 gm |
| fine grind DDS | 20 gm |
| solka floc | 5 gm |
| flavor (menthol) | 15 cc |
| water | 85 cc |
| gum tragacanth | 2 gm |
| potassium carbonate | 2.5 gm |
| nicotine | 4 gm |

The blend is extruded into a rod with a packing density of 275 mg/cm$^{-3}$. The rod is cut into 64 mm lengths and covered with a cigarette paper wrapper. The rod is porous to gas, such as air. When air is drawn through the rod, nicotine and the DDS flavors are volatilized and entrained in the drawn air at ambient (room) temperatures and pressures.

EXAMPLE 9

The procedure of Example 8, supra., is repeated except that the DDS as used therein is replaced with an equal proportion of DDGS. When used by a taste panel of 20 tasters, more than half prefer the taste sensation effected by the article of Example 8 over the taste sensation effected by use of the article of Example 9.

EXAMPLES 10–15

A volume of thin-stillage was filtered through a 60 mesh screen and the filtrate diluted with of a mixture of glycerine and propylene glycol in a ratio of 10:1:/w/w/w. The resulting mixture was applied to stemmed tobacco at levels sufficient to yield solids-on-tobacco of 0.8, 0.6, 0.4, 0.3 and 0.2 percent by weight, respectively. After drying, each of the 5 treated tobaccos were processed into 85 mm filter cigarettes (Examples 10–14). A proportion of the untreated tobacco was blended with 0.6 percent by weight of DDGS and the blend processed into 85 mm filter cigarettes as a control (Example I5).

When smoked, the cigarettes of the invention (Examples 10–14) were found to exhibit reduced harshness and enhanced flavor in comparison to cigarettes made from untreated tobacco. In respect to these improvements, the cigarettes prepared from the 0.3 percent solids-on-tobacco of DDS (Example 13) were equivalent in improvement to the cigarettes of the control Example 15 (prepared with 0.6 percent by weight DDGS additive).

What is claimed is:

1. A smoking material, which consists essentially of tobacco in admixture with a smoke-enhancing proportion of distiller's dried solubles, said mixture being free of distiller's dried grain.

2. The material of claim 1 wherein the proportion of distiller's dried solubles is within the range of from about 0.2 to about 80 percent by weight of tobacco.

3. A smoking material of claim 1 wherein the tobacco is reconstituted tobacco.

4. A composition of matter, which comprises; a homogeneous blend of a smokably acceptable, cellulose substrate and a smoke flavor enhancing proportion of distiller's dried solubles; said composition being free of a compound selected from the group consisting of tobacco, tobacco extracts or distiller's dried grain.

5. A composition of claim 4 wherein the proportion of distiller's dried solubles is within the range of from about 0.2 to about 80 percent by weight of cellulose.

6. The composition of claim 4 in the form of a sheet.

7. The composition of claim 6, shredded.

8. A smoking article, which comprises;

(a) a rod of smoking material which comprises;

a homogeneous blend of a smokably acceptable, cellulose substrate and a smoke flavor enhancing proportion of distiller's dried solubles;

said blend being free of a compound selected from the group consisting of tobacco, tobacco extracts and distiller's dried grain; and (b) paper wrapper means enclosing the rod;

said enclosed rod being open at the ends thereof.

9. The smoking article of claim 8 wherein the blend includes a tobacco.

10. The smoking article of claim 8 wherein one end of the rod is closed with a filter element.

11. A method of casing tobacco, which comprises;

providing tobacco, characterized in part by a harsh smoke; and blending with the provided tobacco a smoke improving proportion of a composition, which consists essentially of;

a homogeneous blend of a smokably acceptable, cellulose substrate and a smoke flavor enhancing proportion of distiller's dried solubles; said homogeneous blend being free of a compound selected from the group consisting of tobacco, tobacco extracts or distiller's dried grain.

12. A tobacco substitute, which comprises;

a non-cellulose compound carrier; and a flavor-enhancing proportion of distiller's dried solubles;

said substitute being free of tobacco and free of distiller's dried grain.

13. The substitute of claim 12 which further comprises nicotine.

14. The substitute of claim 12 wherein the non-cellulose compound is an organic compound.

15. The substitute of claim 14 wherein the organic compound is tragacanth gum.

16. The substitute of claim 12 which further comprises an additional flavor agent.

17. An article which comprises a tobacco substitute of claim 12 disposed in a simulated cigarette form.

18. A method of coating a volatile-releasing substrate with distillers dried solubles, which comprises; coating the substrate with thin-stillage; and drying the coating, whereby the distillers dried solubles is formed in-situ.

* * * * *